US007772528B2

(12) United States Patent
Lewin et al.

(10) Patent No.: US 7,772,528 B2
(45) Date of Patent: Aug. 10, 2010

(54) HEATED BODY MAT

(76) Inventors: Symone Lewin, 23 Harvey Rd., Ridgefield, CT (US) 06877; Gordon B. Bart, 27328 Oak Dr., Sturgis, MI (US) 49091

( * ) Notice: Subject to any disclaimer, the term of this patent is extended or adjusted under 35 U.S.C. 154(b) by 132 days.

(21) Appl. No.: 11/960,486

(22) Filed: Dec. 19, 2007

(65) Prior Publication Data

US 2008/0116190 A1 May 22, 2008

Related U.S. Application Data

(62) Division of application No. 11/239,260, filed on Sep. 29, 2005, now abandoned.

(51) Int. Cl.
*H05B 3/34* (2006.01)
*H01C 3/06* (2006.01)

(52) U.S. Cl. ..... 219/528; 219/529; 219/521; 219/544; 219/552; 219/553; 219/218; 219/212; 219/217; 219/543; 338/211; 338/212

(58) Field of Classification Search ..... 219/528–9, 219/521, 549, 552–553, 218, 212, 217, 543; 338/211–2
See application file for complete search history.

(56) References Cited

U.S. PATENT DOCUMENTS

| | | | | |
|---|---|---|---|---|
| 4,139,763 | A | 2/1979 | McMullan et al. | |
| 4,186,294 | A | 1/1980 | Bender | |
| 4,247,756 | A | 1/1981 | Cucinotta et al. | |
| 4,303,074 | A | 12/1981 | Bender | |
| 4,736,088 | A | 4/1988 | Bart | |
| 4,798,936 | A * | 1/1989 | Johnson, Sr. | 219/217 |
| 5,432,322 | A | 7/1995 | Ingram et al. | |
| D478,451 | S | 8/2003 | Bergen | |
| 6,653,607 | B2 | 11/2003 | Ellis et al. | |
| 2006/0052852 | A1 * | 3/2006 | Wyatt et al. | 607/104 |

OTHER PUBLICATIONS

"Heated Foot and Boot Warmer Mat" web page from matsmatsmats.com downloaded from www.matsmatsmats.com/commercial-industrial/HEATED/heated-foot-warmer-mat.html on Mar. 16, 2005.
Web page from MatBlue.com downloaded from http://people.bu.edu/atq2005/Product Picture.html on Aug. 10, 2005.
Web document entitled "Urethane Foam Quality and Methods of Measurement", by Buckley Industries, Inc, downloaded on Aug. 10, 2005 from http://wwwbuckleyind.com/Products/.Insulation/foam/measurement.pdf.

* cited by examiner

*Primary Examiner*—Shawntina Fuqua
(74) *Attorney, Agent, or Firm*—Gordon & Jacobson, PC

(57) ABSTRACT

A heated body mat realized by an assembly covered by a protective enclosure. The assembly has a major dimension (e.g., length) and includes a heat reflecting layer disposed between a top foam panel and a bottom foam panel. A resistive heater element is arranged in a single loop that provides coverage over a substantial part of the area of the mat. A plurality of thermostats (preferably 3 or more) are integrated as part of the loop and arranged in a series configuration being spaced apart along the major dimension of the assembly. Each one of said thermostats is normally closed and opens at one or more predetermined threshold temperatures to thereby open the current path loop realized by the resistive heater element. In use, electric power is supplied to the resistive heater element to generate heat that is emitted from the mat.

13 Claims, 2 Drawing Sheets

HEATED BODY MAT

CROSS-REFERENCE TO RELATED APPLICATION

This application is a divisional of U.S. application Ser. No. 11/239,260, filed on Sep. 29, 2005, now abandoned which is hereby incorporated herein by reference in its entirety.

BACKGROUND OF THE INVENTION

1. Field of the Invention

This invention relates broadly to exercise mats and other types of mats that lie on the floor or other surface and support the user's body during use. More particularly, this invention relates to heating mechanisms for such mats.

2. State of the Art

Exercise mats provide a comfortable support surface between the user's body and the floor during use. Typically, such mats are constructed from dense foam that provides a necessary amount of cushion and stability. However, such mats typically do not provide an active heating mechanism and thus are uncomfortably cold when placed on a cold floor.

It has been proposed to provide an exercise mat with an active heating element supported below a foam mat support layer (see http://people.bu.edu/atq2005/index.html). Disadvantageously, such an arrangement would allow a large amount of heat to be dissipated to the floor and thus waste energy. The proposed arrangement also fails to provide adequate protection against overheating and thus can be dangerous to use.

Thus, there remains a need in the art to provide an improved exercise mat that employs an active heating mechanism that minimizes the heat dissipated to the floor and thus conserves energy and also provides adequate protection against overheating.

SUMMARY OF THE INVENTION

It is therefore an object of the invention to provide an exercise mat that employs an active heating mechanism that minimizes the heat dissipated to the floor or other support surface.

It is another object of the invention to provide such an exercise mat that provides adequate protection against overheating.

It is a further object of the invention to provide a body mat that provides active heating along with adequate protection against overheating, which is suitable for other applications (e.g., yoga, flexibility training, therapeutic relief, chiropractic therapy, physical therapy, heat therapy, rehabilitation, etc).

In accord with these objects, which will be discussed in detail below, a heated body mat is realized by an assembly covered by a protective enclosure. The assembly has a major dimension (e.g., length) and includes a heat reflecting layer disposed between a top foam panel and a bottom foam panel. A resistive heater element is arranged in a single electrical loop that provides coverage over a substantial part of the area of the mat. A plurality of thermostats (preferably 3 or more) are integrated as part of the loop and arranged in a series configuration being spaced apart along the major dimension of the assembly. Each one of the thermostats is normally closed and opens at one or more predetermined threshold temperatures to thereby open the current path loop realized by the resistive heater element. In the preferred embodiment, the thermostats are adapted such that they normally remain closed and open to open-circuit the current path loop of the resistive heater element when the matt is misused (e.g., rolled-up or left plugged-in for a long time period). In use, electric power is supplied to the resistive heater element to generate heat that is emitted from the mat.

It will be appreciated that when the heat generated by the exercise mat provides improved comfort when exercising on cold floors or other support surface while providing protection against overheating. It can also be used for added comfort and possibly therapeutic purposes in other applications.

According to the preferred embodiment of the invention, the top and bottom foam panels of the assembly are realized with a foam of a density in a range between 2.7 to 2.9 lbs per cubic foot with a ball rebound factor on the order of 50%, a 25% Indentation Load Deflection (ILD) in a range between 54 and 56 lbs, and a 65% (ILD) in a range between 118 and 145 lbs. Moreover, the top foam panel preferably has a thickness between ⅛ inches and ⅜ inches, and the bottom foam panel preferably has a thickness between 1 inch and 2 inches. These specific foam parameters provide stability and comfort during exercise. Other types of foam can be used for different applications.

Additional objects and advantages of the invention will become apparent to those skilled in the art upon reference to the detailed description taken in conjunction with the provided figures.

DETAILED DESCRIPTION

Figure 1:
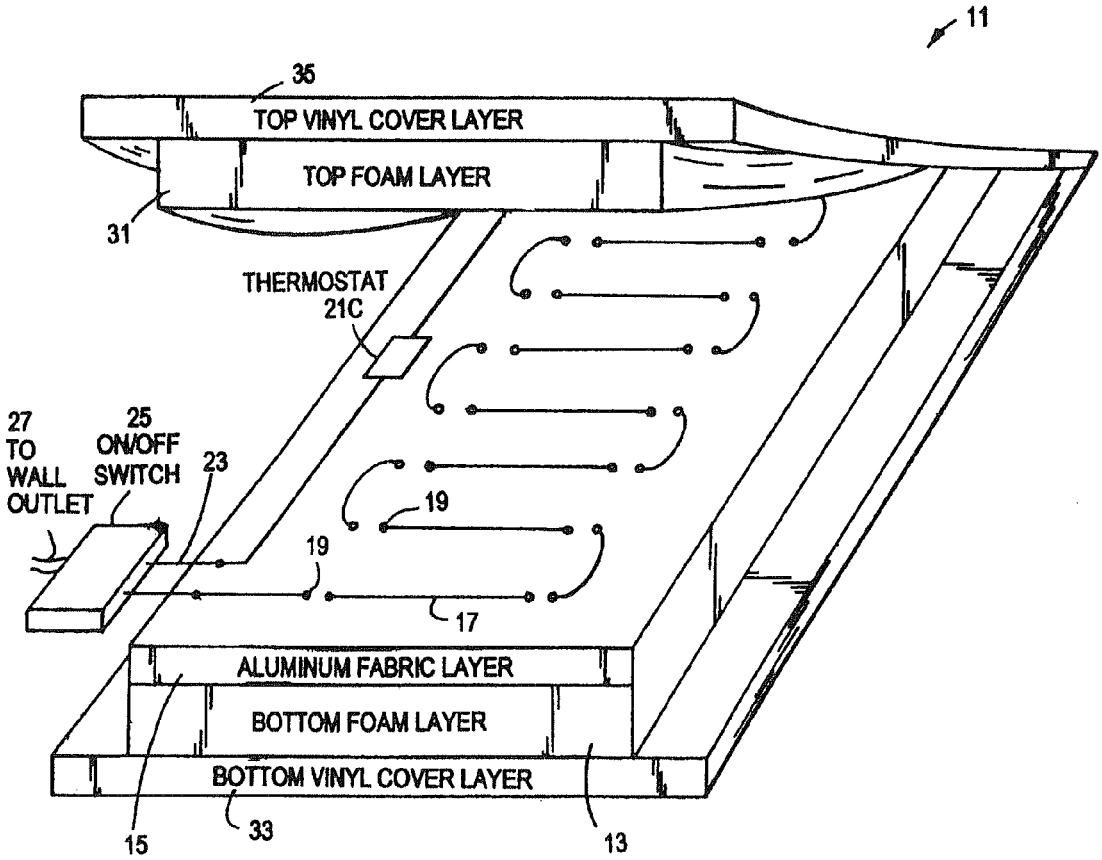
FIG. 1 is a partially disassembled perspective view of an exercise mat in accordance with the present invention.
Figure 2:
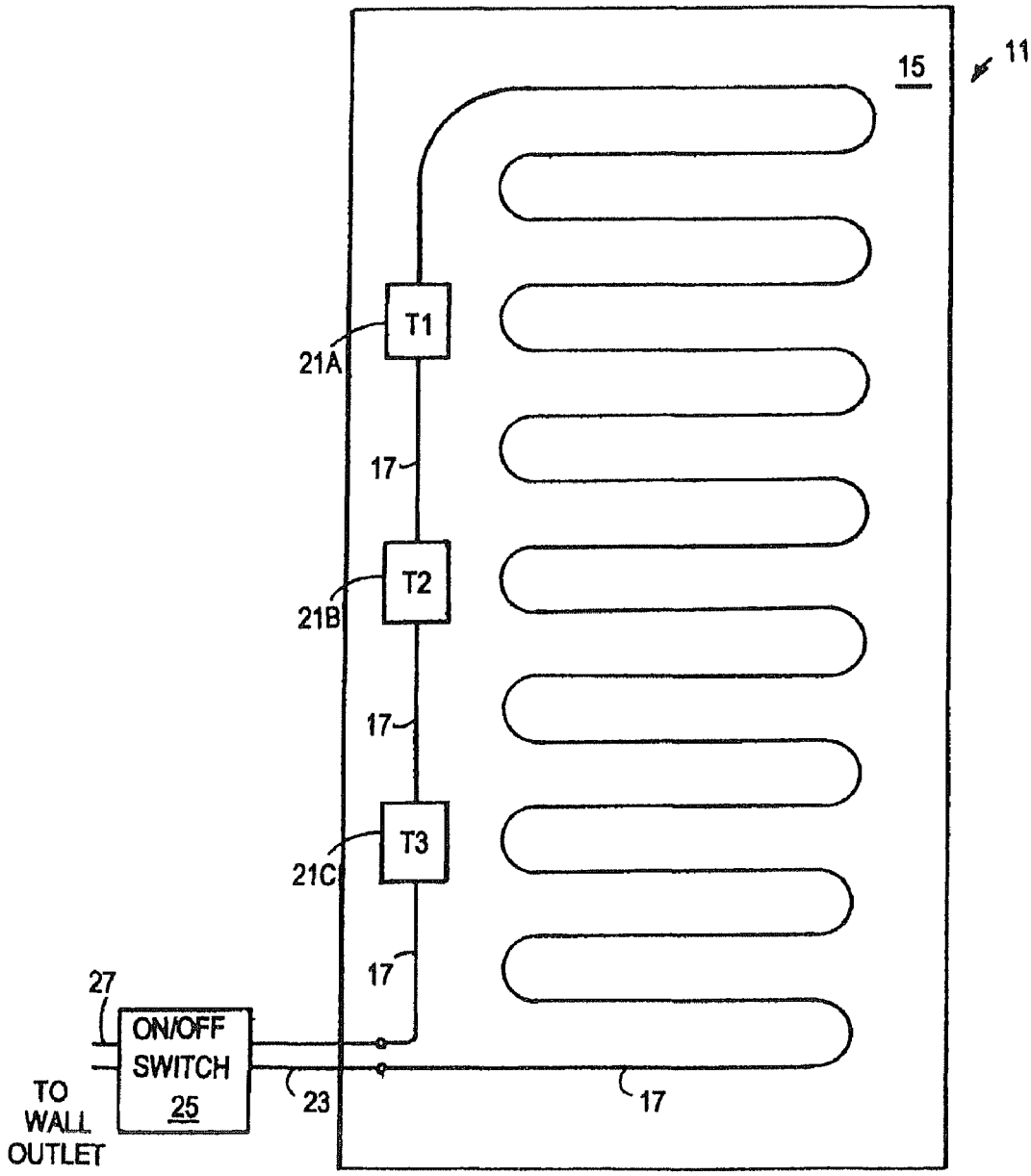
FIG. 2 is a schematic view of the resistive heating element and associated power control circuitry of the exercise mat of FIG. 1.

Turning now to FIG. 1, an improved exercise mat 11 is shown in perspective. The exercise mat 11 includes a bottom foam layer 13 that is covered by an aluminum fabric layer 15. In the preferred embodiment, the aluminum fabric layer 15 is realized from a nylon-cotton duck fabric, although other flexible heat-reflecting fabric material(s) can be used. A single loop of resistance wire 17, which is preferably realized from various alloys insulated with silicone or PVC, is laced through holes 19 in the aluminum fabric layer 15 to thereby secure the resistance wire loop in place. The resistance wire loop 17 preferably traverses back and forth along the length of the mat 11 to provide coverage over a substantial part of the area of the mat as best shown in FIG. 2. The resistive wire loop 17 provides heating when electric power is supplied thereto. The aluminum fabric layer 15 reflects heat generated by the resistive wire loop 17 such that minimal heat loss occurs through the bottom foam layer 13 to the floor during use. The aluminum fabric layer 15 also acts like a heat sink and dispenses the heat evenly over the top foam layer 31/top cover layer 35 as described below. Three thermostats 21A, 21B, 21C are integrated as part of the loop and are arranged in a series configuration. The thermostats 21A, 21B, 21C are normally closed and only open at a predetermined threshold temperature, preferably at a temperature between 75° C. and 167° C. (although, if desired the thermostats may be set to open at different temperatures). In the event that any one of the three thermostats are opened, the "open" thermostat(s) breaks the current path realized by the resistance wire loop 17 to terminate the heating generated by the resistive wire loop, thereby protecting against overheating. In order to protect against overheating along the length of the mat, the three thermostats 21A, 21B, 21C are spaced apart from one another along one side of the mat over the length dimension of the mat as best shown in FIG. 2. This configuration protects against overheating that may occur in the event the mat 11 is bunched, folded or rolled while in the "ON" condition. The thermostats 21A, 21B, 21C are preferably affixed to the aluminum fabric layer 15 by an adhesive tape, a hot-melt adhesive or other suitable means.

Electrical wires 23 (e.g., a two-wire electrical cord) are attached to the terminations of the resistive wire loop 17 by connector, solder or other suitable electrical connection means. The electrical wires 23 extend to an ON/OFF switch 25 that is coupled by electric wires 27 to a mains power outlet (not shown). The ON/OFF switch 25 enables the user to selectively turn on and off the supply of electrical power that flows from the mains power outlet to the resistive heater loop. The ON/OFF switch 25 may provide additional control functionality, such as the ability to vary the power level delivered to the resistive wire loop 17 (and thus the heating level provided by the resistive wire loop 17) or timer circuitry that shuts off the electrical power delivered to the resistive wire loop 17 upon expiration of a predetermined time period. The ON/OFF switch 25 may also provide additional protection functionality, such as a fuse that protects against large currents reaching the resistive wire loop 17 and possible a varistor that protects against large voltage spikes reaching the resistive wire loop 17. The ON/OFF switch 25 may also employ AC/DC conversion circuitry that converts the AC mains power signal to a DC signal that is supplied to the resistive wire loop for DC resistive heating.

A top foam layer 31 covers the resistance wire loop 17. The assembly including the bottom foam layer 13, the aluminum fabric layer 15 and the resistive wire loop 17 and thermostats 21A, 21B, 21C affixed thereto, and the top foam layer 31 are placed in a vinyl pouch, which is realized by a bottom vinyl cover layer 33 and a top vinyl cover layer 35. The vinyl pouch is then sewn to secure the assembly therein.

The bottom and top foam layers 13, 31 electrically insulate the resistive wire loop 17 from the other parts of the mat as well as the floor and the user's body. The bottom and top foam layers 13, 31 also protect the resistive wire loop 17. The top foam layer 31 also prevents the user from feeling the resistive wire loop 17 during use.

In the preferred embodiment, the top and bottom foam layers 13, 31 are realized with a foam of a density in a range between 2.7 to 2.9 lbs per cubic foot with a ball rebound factor on the order of 50%, a 25% Indentation Load Deflection (ILD) in a range between 54 and 56 lbs, and a 65% (ILD) in a range between 118 and 145 lbs. The ball rebound factor is derived from a test that measures the surface resiliency of the foam. The test involves dropping a steel ball of known mass from a pre-determined height onto a foam sample. The rebound height of the steel ball, expressed as a percentage of the original drop height, is the ball rebound factor. ILD is the unit of measure that lets the degree of firmness or softness of a foam that is expressed in lbs at a given percent deflection of the foam. To obtain the ILD value, a 50 square inch circular plate is pushed into the foam top surface, stopping at a given deflection, and reading a load on a scale. For example, a 25% ILD of 30 lbs means that it takes a 30 pound load to compress a 4 inch piece of foam to a 3 inch thickness. The higher the ILD value, the firmer the foam. In the preferred embodiment, the top foam layer 31 has a thickness between ⅛ inches and ⅜ inches (most preferably ¼ inches), while the bottom foam layer 13 has a thickness between 1 inch and 2 inches. The specific foam parameters set forth above are preferred for stability and comfort of the user during exercise. Other types of foam can be used for different applications (such as mats for yoga, flexibility training, therapeutic relief, chiropractic therapy, physical therapy, heat therapy, rehabilitation, etc). The resultant matt assembly 11 has a cuboid shape with a thickness preferably between ⅝ inches and 2⅜ inches (most preferably on the order of 2 inches thick), a length preferably between 40 inches and 100 inches (most preferably on the order of 72 inches), and a width between 15 inches and 48 inches (most preferably on the order of 24 inches).

Advantageously, the heat generated by the exercise mat provides improved comfort when exercising on cold floors or other support surfaces while providing protection against overheating. It can also be used for added comfort and possibly therapeutic purposes in other applications.

There have been described and illustrated herein an embodiment of a heat exercise mat. While particular embodiments of the invention have been described, it is not intended that the invention be limited thereto, as it is intended that the invention be as broad in scope as the art will allow and that the specification be read likewise. Thus, while particular materials have been disclosed for the heat reflecting layer, the resistive heating element and the cover of the mat assembly, it will be appreciated that other material (such as positive temperature coefficient wire or conductive polymer heaters) can be used as well. In addition, while particular types of foam have been disclosed, it will be understood that other types of foam can be used as well. It is also contemplated that the resistive heating element can be secured to another layer of the assembly, such as to the top of the aluminum fabric layer preferably by being laced through holes therein (which allows for omission of the fabric layer). Moreover, while particular configurations have been disclosed in reference to the number and locations of the protection thermostats over the length of the mat, it will be appreciated that other configurations could be used as well. For example, and not by way of limitation, more than three protection thermostats can be arranged in series and distributed over the length and possibly the width of the mat for additional overheating protection. Furthermore, it is contemplated that the functionality of the ON/OFF switch as described above can readily be adapted such that it is housed as part of the mat assembly itself. It is also contemplated that the shape and size of the body mat can be varied and/or that the matt can be used on other support surfaces (for example, on table tops). It will therefore be appreciated by those skilled in the art that yet other modifications could be made to the provided invention without deviating from its spirit and scope as claimed.

What is claimed is:

1. A heated body mat comprising:

an assembly covered by a protective enclosure, the assembly having a major dimension and including a top foam panel, a bottom foam panel, a heat reflecting layer disposed between the top foam panel and the bottom foam panel, a resistive heater element arranged in a single loop that provides coverage over a substantial part of the area of the mat, and a plurality of thermostats that are integrated as part of the loop and arranged in a series configuration being spaced apart along the major dimension, wherein each one of said thermostats is normally closed and opens at one or more predetermined threshold temperatures to thereby open the current path loop realized by the resistive heater element;

wherein the heat reflecting layer comprises a flexible fabric material, and the resistive heater element comprises a resistive wire that passes through holes in the heat reflecting layer.

2. A heated body mat according to claim 1, wherein:
the flexible fabric material comprises nylon-cotton duck fabric.

3. A heated body mat according to claim 1, wherein:
the heat reflecting layer comprises an aluminum fabric material.

4. A heated body mat according to claim 1, wherein:
at least one of the first and second foam panels is realized with a foam having a density in a range between 2.7 to 2.9 lbs per cubic foot.

5. A heated body mat according to claim 1, wherein:
at least one of the first and second foam panels is realized with a foam having a ball rebound factor on the order of 50%.

6. A heated body mat according to claim 1, wherein:
at least one of the first and second foam panels is realized with a foam having a 25% ILD in a range between 54 and 56 lbs and a 65% ILD in a range between 118 and 145 lbs.

7. A heated body mat according to claim 1, wherein:
said first foam panel has a thickness between ⅛ inches and ⅜ inches, and said second foam panel has a thickness between 1 inch and 2 inches.

8. A heated body mat according to claim 1, further comprising:
means for supplying electric power to the resistive heater element to generate heat that is emitted from the mat.

9. A heated body mat according to claim 1, wherein:
said plurality of thermostats comprise at least three thermostats.

10. A heated boy mat according to claim 1, wherein:
said assembly has a characteristic length dimension and said plurality of thermostats are spaced apart over said characteristic length dimension.

11. A heated body mat according to claim 1, wherein:
said assembly is substantially rectangular in shape with characteristic length and width dimensions and said plurality of thermostats are spaced apart over the characteristic length dimension.

12. A heated body mat according to claim 11, wherein:
said plurality of thermostats are disposed along a lengthwise edge of said rectangular-shaped assembly.

13. A heated body mat according to claim 1, wherein:
said protective enclosure comprises vinyl.

* * * * *